US012222164B2

(12) United States Patent
Indyka et al.

(10) Patent No.: US 12,222,164 B2
(45) Date of Patent: Feb. 11, 2025

(54) COMPACT COOLING ASSEMBLY WITH MULTIPLE HEAT EXCHANGERS

(71) Applicant: Valeo Autosystemy Sp. z o.o., Skawina (PL)

(72) Inventors: Michal Indyka, Skawina (PL); Piotr Las, Skawina (PL); Mateusz Nawrocki, Skawina (PL); Adam Sontag, Skawina (PL)

(73) Assignee: VALEO AUTOSYSTEMY SP. Z O.O, Skawina (PL)

( * ) Notice: Subject to any disclaimer, the term of this patent is extended or adjusted under 35 U.S.C. 154(b) by 242 days.

(21) Appl. No.: 17/794,393

(22) PCT Filed: Jan. 21, 2021

(86) PCT No.: PCT/EP2021/051333
§ 371 (c)(1),
(2) Date: Jul. 21, 2022

(87) PCT Pub. No.: WO2021/148535
PCT Pub. Date: Jul. 29, 2021

(65) Prior Publication Data

US 2023/0049902 A1 Feb. 16, 2023

(30) Foreign Application Priority Data

Jan. 23, 2020 (EP) ..... 20461507

(51) Int. Cl.

| | |
|---|---|
| ***F28D 1/00*** | (2006.01) |
| ***F28D 1/04*** | (2006.01) |
| ***F28F 9/02*** | (2006.01) |
| *F28D 21/00* | (2006.01) |

(52) U.S. Cl.
CPC ..... *F28D 1/0443* (2013.01); *F28F 9/0224* (2013.01); *F28F 9/0243* (2013.01); *F28D 2021/008* (2013.01); *F28F 2009/0297* (2013.01)

(58) Field of Classification Search
CPC ..... F28F 2280/02; F28F 2280/06; F28F 2275/085; F28F 2275/146;
(Continued)

(56) References Cited

U.S. PATENT DOCUMENTS 6,273,184 B1 * 8/2001 Nishishita ..... F28D 1/05383 165/175
6,789,613 B1 * 9/2004 Ozaki ..... F28D 1/0452 165/140
(Continued)

FOREIGN PATENT DOCUMENTS

| | | | |
|---|---|---|---|
| EP | 2080690 | A1 | 7/2009 |
| JP | 2010255868 | A | 11/2010 |
| WO | 2017046532 | A1 | 3/2017 |

OTHER PUBLICATIONS

International Search Report and Written Opinion in corresponding International Application No. PCT/EP2021/051333, dated Apr. 15, 2021 (9 pages).

*Primary Examiner* — Travis Ruby
(74) *Attorney, Agent, or Firm* — Osha Bergman Watanabe & Burton LLP

(57) ABSTRACT

A cooling assembly for a motor vehicle, the cooling assembly having a primary heat exchanger comprising a pair of primary collector boxes, the primary collector boxes with primary header plates, the primary header plates being of essentially rectangular shape; a plurality of primary tubes stacked between the primary header plates; a secondary heat exchanger comprising a pair of secondary collector boxes with secondary header plates being of essentially rectangular
(Continued)

shape; a plurality of secondary tubes stacked between the secondary collector boxes. The primary heat exchanger and the secondary heat exchanger are arranged in parallel, perpendicularly to each other so that the secondary header plates of the secondary heat exchanger at least partially overlap the stack of the primary tubes of the primary heat exchanger.

10 Claims, 2 Drawing Sheets

(58) Field of Classification Search
CPC ..... F28F 2009/004; F28F 9/002; F28F 2009/0297; F28F 9/0243; F28F 9/0224; F28D 1/0443; F28D 1/0435; F28D 2021/008
See application file for complete search history.

(56) References Cited

U.S. PATENT DOCUMENTS

| | | | | |
|---|---|---|---|---|
| 2009/0178781 | A1 | 7/2009 | Park | |
| 2015/0047808 | A1 | 2/2015 | Takahashi et al. | |
| 2015/0047814 | A1 | 2/2015 | Wilkins et al. | |
| 2015/0377560 | A1* | 12/2015 | Szostek ..... | F28F 9/0214 165/173 |
| 2016/0236656 | A1* | 8/2016 | Malec ..... | B60S 1/3853 |
| 2019/0001807 | A1* | 1/2019 | Han ..... | F28F 9/002 |
| 2019/0257244 | A1* | 8/2019 | Hankwitz ..... | F01P 11/10 |

* cited by examiner

COMPACT COOLING ASSEMBLY WITH MULTIPLE HEAT EXCHANGERS

FIELD OF THE INVENTION

The invention relates to a cooling assembly, in particular to a cooling assembly for a motor vehicle.

BACKGROUND OF THE INVENTION

Heat exchangers in motor vehicles are usually responsible for thermal management of the powertrain, the air conditioning system, the power steering system, or others. This pertains to, for example, internal combustion vehicles and electric vehicles, wherein heat management may affect emission levels, fuel or energy consumption, driving range, etc.

Heat exchangers these days may be made of metal components, such as aluminum, assembled with synthetic components, such as plastic. The sub-components responsible for heat exchange, such as a heat exchanger core comprising tubes assembled with headers, are usually made of metal, whereas the sub-components responsible for delivering or collecting the media, such as tanks, may be made of a synthetic material.

There is an increased interest in reducing the size of particular sub-components of motor vehicles. On the other hand, reducing the size of, for example, heat exchangers, may impact thermal performance of the whole motor vehicle.

The size of a heat exchanger may be reduced by implementing specific architectures that provide the same or better efficiency while using a smaller amount of space. As a result, the packaging in the motor vehicle may increase.

The existing solutions focus mainly on reducing the size of particular sub-components or decreasing the distance between heat exchangers. Usually the headers of at least two heat exchangers are assembled in close vicinity in order to reduce the total dimensions of created module. The manifolds arranged in parallel may however collide either with the tubes, or themselves. Thus, arranging the heat exchangers too close to each other may lead to a collision between them, which may result in noise, vibrations or even system malfunction.

In view of the problems featured by the state of the art, it would be desirable to create a module comprising at least two heat exchangers, which would mitigate a risk of collision between them, significantly reduce dimensions of the module and be easy to apply.

SUMMARY OF THE INVENTION

The object of the invention is a cooling assembly, in particular for a motor vehicle, the cooling assembly comprising: a primary heat exchanger comprising a pair of primary collector boxes, the primary collector boxes with primary header plates, the primary header plates being of essentially rectangular shape; a plurality of primary tubes stacked between the primary header plates; a secondary heat exchanger comprising a pair of secondary collector boxes with secondary header plates being of essentially rectangular shape; a plurality of secondary tubes stacked between the secondary collector boxes, wherein the primary heat exchanger and the secondary heat exchanger are arranged in parallel, perpendicularly to each other so that the secondary header plates of the secondary heat exchanger at least partially overlap the stack of the primary tubes of the primary heat exchanger.

Preferably, the width of the primary header plates is bigger than the width of the secondary header plates.

Preferably, the width of the secondary header plates is equal to the width of the primary header plates.

Preferably, the width of the secondary header plates is greater than the width of the primary header plates.

Preferably, the distance between the stack of the primary tubes and the stack of the secondary tubes of the adjacent heat exchangers is smaller than the distance between the longer side of the secondary header tank and the longer side of the secondary tube, from the side which faces the primary tubes.

Preferably, the secondary collector boxes comprise a plurality of protruding clips, and the primary collector boxes comprise a plurality of slots configured to receive said clips so that the heat exchangers are immobilized with respect to each other.

Preferably, the dips and slots are deployed on the corner portions of the heat exchangers.

Preferably, the collector boxes comprise shoulders protruding in a longitudinal direction from the terminal ends thereof, configured to accommodate the clips and slots respectively.

Preferably, the cooling assembly comprises a frame configured to support at least one heat exchanger.

Preferably, the frame forms a screen for protecting the collector boxes and the header plates, the screen being in form of at least one wall parallel to the plane delimited by the stack of tubes and overlapping at least one tank of any heat exchanger.

Preferably, the cooling assembly further comprises a tertiary heat exchanger, the tertiary heat exchanger comprising tertiary header plates, the tertiary header plates being parallel to the primary header plates.

BRIEF DESCRIPTION OF DRAWINGS

Examples of the invention will be apparent from and described in detail with reference to the accompanying drawings, in which.

DETAILED DESCRIPTION OF EMBODIMENTS

The heat exchangers are usually assembled onto the front-end of the vehicle not only as the as a standalone heat exchange units, but also as the assembly of two or more heat exchangers. Installing the assemblies comprising several heat exchangers instead of one after the other is advantageous in terms of production feasibility, cost reduction, packaging, etc.

The assembly of heat exchangers may be further referred to as the cooling assembly 1. The invention may concern various types of heat exchangers, for example radiators, condensers, charge air coolers, or others.

Figure 1:
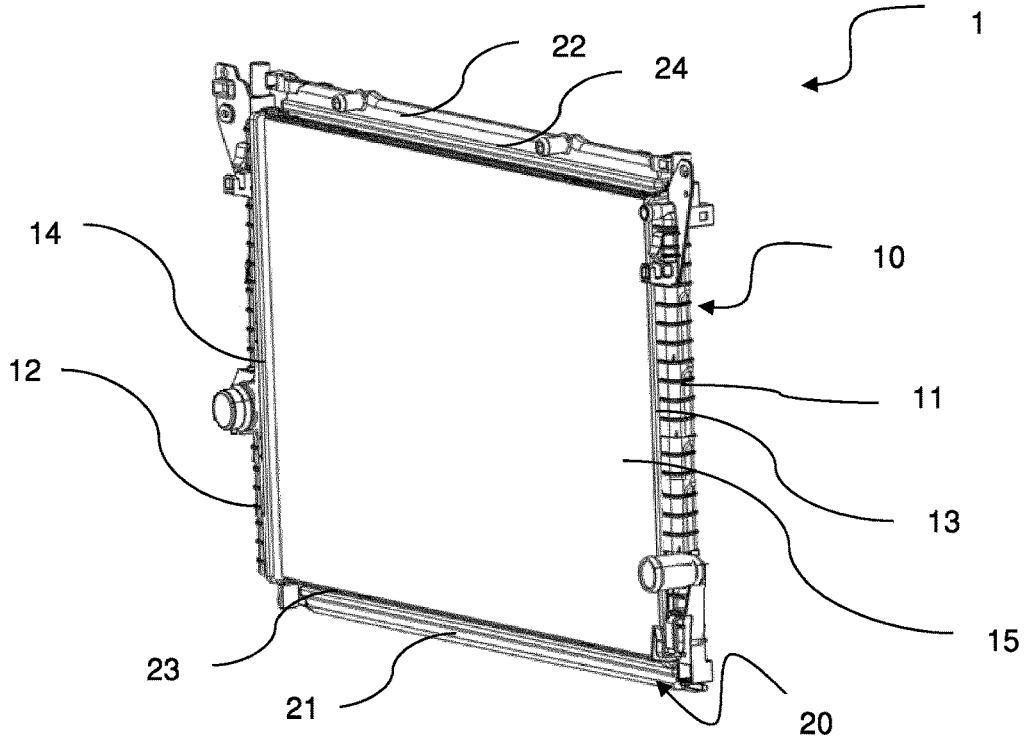
FIG. 1 shows a perspective view of a cooling assembly.

FIG. 1 shows a cooling assembly 1 comprising a primary heat exchanger 10 assembled with a secondary heat exchanger 20. For example, the primary heat exchanger may be adapted for a coolant loop and the secondary heat exchanger 20 may be adapted for refrigerant loop.

The primary heat exchanger 10 comprises a pair of primary collector boxes 11, 12 assembled with primary header plates 13, 14 to form a primary manifold for the primary fluid (e.g. coolant).

The primary collector boxes 11, 12 may be in form of elongated containers made of synthetic material that are configured to distribute or collect the heat exchange fluid. Using other materials is also envisaged, depending on the type of the primary heat exchanger 10. Both collector boxes 11, 12 usually comprise openings having substantially rectangular cross-section for receiving primary header plates 13, 14 with primary tubes 15 stacked one after the other for heat exchange. The shape of the primary collector boxes 11, 12 presented in the FIG. 1 ensures a homogenous distribution of heat exchange fluid, yet other shapes of the primary collector boxes 11, 12 that will provide similar or better performance are also envisaged. Alternatively, a reversed flow through the primary heat exchanger 10 is also envisaged.

The primary header plates 13, 14 may be of essentially rectangular shape. Term "essentially rectangular" means that the header plates 13, 14 comprise at least two longer sides parallel with respect to each other, and two shorter sides also parallel with respect to each other, with flat top and bottom sides there between. The primary header plates 13, 14 may be made of a lightweight metal alloy, for example aluminum. The shape of the primary header plates 13, 14 corresponds to the shape of the opening in the collector boxes 11, 12 to provide a fluid-tight connection. The primary header plates 13, 14 may be made of a different material than the primary collector boxes 11, 12, so both sub-components can be joined by crimping one to the other.

The primary heat exchanger 10 further comprises a plurality of primary tubes 15 deployed in parallel to each other between the primary header plates 13, 14. The primary tubes 15 comprise open ends received in the primary header plates 13, 14.

The primary tubes 15 may be made of a folded sheet of metal. Alternatively, the primary tubes 15 can be extruded. The tubes 15 may be interlaced with heat dispersion portions, commonly known as fins.

The secondary heat exchanger 20 comprises a pair of secondary collector boxes 21, 22 assembled with secondary header plates 23, 24 to form a secondary manifold for the secondary medium (e.g. refrigerant).

The secondary collector boxes 21, 22 may be in form of elongated containers made of metal that are configured to distribute or collect the secondary medium. Using other materials is also envisaged, depending on the type of the secondary heat exchanger 20. Alternatively, a reversed flow through the secondary heat exchanger 20 is allowed. Both collector boxes 21, 22 are configured to be fixed onto the secondary header plates 22, 23, for example by brazing one to the other. The shape of the secondary collector boxes 21, 22 presented in the FIG. 1 ensures a homogenous distribution of secondary medium, yet other shapes of the secondary collector boxes 21, 22 that will provide similar or better performance are also envisaged.

The secondary header plates 22, 23 may be of essentially rectangular shape. Term "essentially rectangular" should be defined analogically as for the primary header plates 13, 14. The secondary header plates 22, 23 may be made of a lightweight metal alloy, for example aluminum. The secondary header plates 22, 23 may comprise protrusions configured to facilitate assembling them with the secondary collector boxes 21, 22. The secondary header plates 23, 24 may be made of the same material as the secondary collector boxes 21, 22, so both sub-components are usually joined by brazing to provide a fluid-tight connection.

The secondary heat exchanger 20 further comprises a plurality of secondary tubes 25 deployed in parallel to each other between the secondary header plates 23, 24. The secondary tubes 25 comprise open ends received in the secondary header plates 23, 24. The secondary tubes 25 may be produced out of the same material and during the same process as the primary tubes 15, however, its shape and size may be different. Similarly to the primary tubes 15, the secondary tubes 25 may be interlaced with fins.

Depending on the architecture, the secondary heat exchanger 20 may further comprise a bottle (not shown) fixed to one of the collector boxes 21, 22. The bottle is usually connected to one of the collector boxes 21, 22.

The heat exchangers form a cooling assembly 1 in which the primary heat exchanger 10 and the secondary heat exchanger 20 are arranged in parallel, perpendicularly to each other, so that the secondary header plates 23, 24 of the secondary heat exchanger 20 at least partially overlap the stack of primary tubes 15 the primary heat exchanger 10, as shown in FIG. 1, when viewed along the main axes of the secondary tubes 25. What is meant here by term "perpendicularly" is that the main axes of the tubes of the respective neighbouring heat exchangers are perpendicular to each other, and so are the header plates thereof. In this way, the space of the whole assembly can be reduced, as the distance between heat exchangers is minimised.

Figure 2:
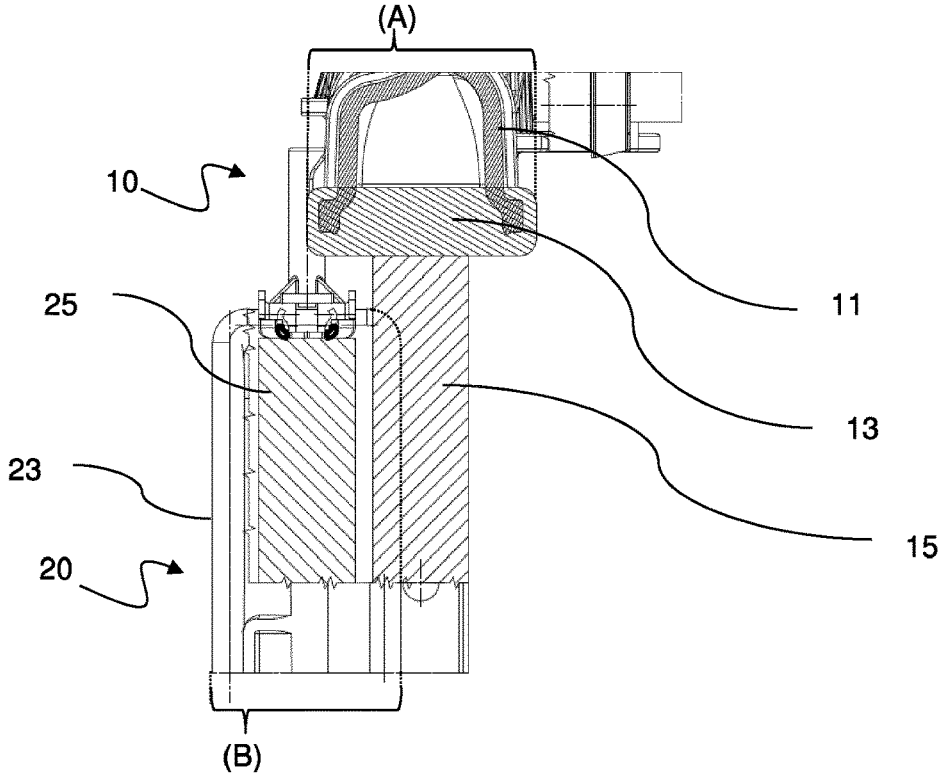
FIG. 2 shows a partial cross-section of the cooling assembly.

FIG. 2 shows a detailed arrangement of the secondary heat exchanger 20 with respect to the primary heat exchanger 10. The partial cross-section shows that the primary header plate 13 is arranged perpendicularly with respect to the secondary header plate 23. Consequently, the primary collector box 11 is arranged perpendicularly with respect to the secondary collector box 21. With respect to the tubes 15, 25, the stack of secondary tubes 25 is also arranged perpendicularly with respect to the stack of primary tubes 15. In other words, at least two heat exchangers 10, 20 are essentially rotated with respect to each other by 90 degrees.

Depending on the heat exchanger assembly 1 architecture, the secondary heat exchanger 20 may comprise the secondary header plate 23, which is shorter than the primary tubes 15 of the primary heat exchanger 10. As the result, the secondary header plate 23 may at least partially overlap the stack of primary tubes 15. In particular, the outline of secondary header plates 23, 24 overlaps the outline of the stack of primary tubes 15, when viewed along the axes of the secondary tubes 25. Analogically to the previous example, the outline which at least partially overlaps the stack of the secondary tubes 25 may be defined by the faces of the primary header plates 13, 14 facing the secondary tubes 25. As a consequence, the primary header plate 13, 14 may at least partially overlap the stack of the secondary tubes 25. Each of the heat exchangers 10, 20 may comprise at least a section of their header plates 13, 14, 23, 24 which partially overlaps the stack of the tubes 15, 25 of the other heat exchanger. The extent of the overlap for one header plate and/or the other may vary depending on the width of the header plates 13, 14, 23, 24, i.e. the length of the shorter side thereof. As shown in FIG. 2, the width of the primary heat exchanger 10 is further referred to as (A) and the width of the secondary heat exchanger 20 is further referred to as (B).

As further shown in FIG. 2, the extent of the overlapping of the tubes 15, 25 by the header plates 13, 14, 23, 24 may vary. The secondary header 23 plate overlaps the primary tubes 15, so that the overlapping area is located between the edge of the primary tube 15 which faces the secondary header plate 23 and the main axis thereof. The main axis of the tubes 15, 25 may be defined as the centre line of the fluid conduit. Further overlap is of course also possible. The primary header 13 overlaps the secondary tubes 25 analogously.

As previously mentioned, the width of the header plates 13, 14, 23, 24 may vary, depending on the type of the heat exchanger and the architecture of the heat exchange assembly 1. For example, primary header plates 13, 14 may be of greater width (A) than the width (B) of the secondary header plates 23, 24. Alternatively, the width (A) of the secondary header plates 21, 22 may be equal to the width (B) of the primary header plates 11, 12. Alternatively, the width (B) of the secondary header plates 21, 22 may be greater than the width (A) of the primary header plates 11, 12.

Furthermore, the distance between the stack of the primary tubes 15 and the stack of the secondary tubes 25 of the adjacent heat exchangers 10, 20 may be smaller than the distance between the longer side of the secondary header tank 23, 24 and the longer side of the secondary tube 25, from the side which faces the primary tubes 15.

Figure 3:
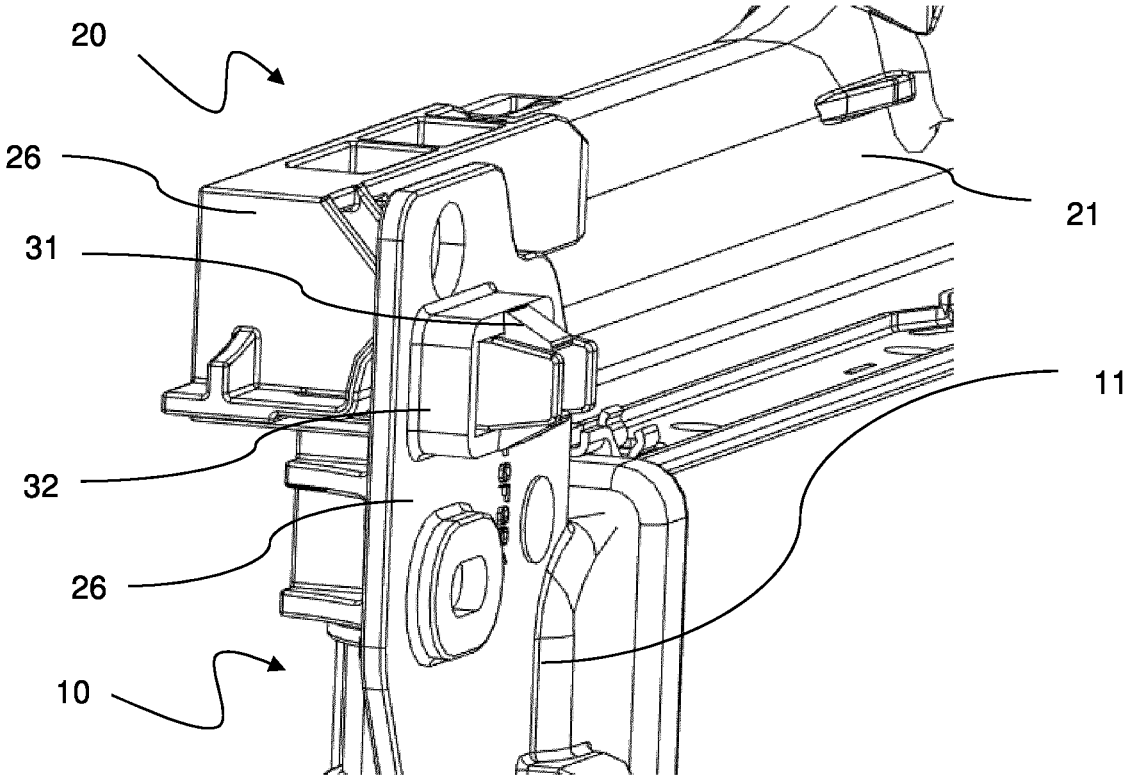
FIG. 3 shows a perspective view of a detachable locking means of the cooling assembly.

FIG. 3 shows an example of forming a cooling assembly 1 using neighbouring heat exchangers 10, 20. In order to create a cooling assembly 1, the primary heat exchanger 10 may be fixed to the secondary heat exchanger 20 permanently or by the means of detachable locking means. The heat exchanger 10, 20 may comprise at least one detachable locking means. In particular, the secondary collector boxes 21, 22 may comprise protruding clips 31, and the primary collector boxes 11, 12 may comprise slots 32 configured to receive said clips 31, so that the heat exchangers 10, 20 are immobilized with respect to each other. Alternatively, the secondary collector boxes 21, 22 may comprise the plurality of slots 32 and the primary collector boxes 11, 12 may comprise the plurality of protruding clips 31, configured to be introduced into said slots 32, so that the heat exchangers 10, 20 are immobilized with respect to each other. Both clips 31 and the slots 32 may be integrated with the corresponding collector boxes 11, 12, 21, 22. The clips 31 and slots 32 may be made of the synthetic material, preferably having the same properties as sub-component to which they are fixed.

Alternatively, one could use other types of detachable locking means, for example, bolts screws or others.

The clip 31 may be arranged perpendicularly with respect to the longer side of the collector boxes 11, 12, 21, 22. Alternatively, the clip 31 may be arranged parallel or at an angle with respect to the longer side of the collector boxes 11, 12, 21, 22.

The clips 31 and the slots 32 may be deployed on the corner portions of the heat exchangers 10, 20. The corner portion of the primary heat exchanger 10 and/or the secondary heat exchanger 20 may be defined as an area in the vicinity of the terminal end of the primary collector boxes 11, 12 and/or the secondary collector boxes 21, 22. Alternatively, the embodiments in which the heat exchanger 10, 20 comprises the clips 31 and the slots 32 in the area between the corner portions of the respective collector boxes 11, 12, 21, 22 are also envisaged. In some applications the heat exchanger 10, 20 may also comprise a shoulder 26 which is configured to serve as an extension of the collector boxes 11, 12, 21, 22 bodies. The shoulders 26 enable fixing the detachable locking means such as clips 31 and slots 32 beyond the vicinity of the collector boxes 11, 12, 21, 22. The shoulders 26 may further enable offsetting the clips 31 or the slots 32 in any direction of the collector boxes 11, 12, 21, 22, depending on the shape thereof. For example, the clip 31 may be offset with respect to the collector box 11, 12, 21, 22 in their longitudinal direction and in their transverse direction at the same time.

Figure 4:
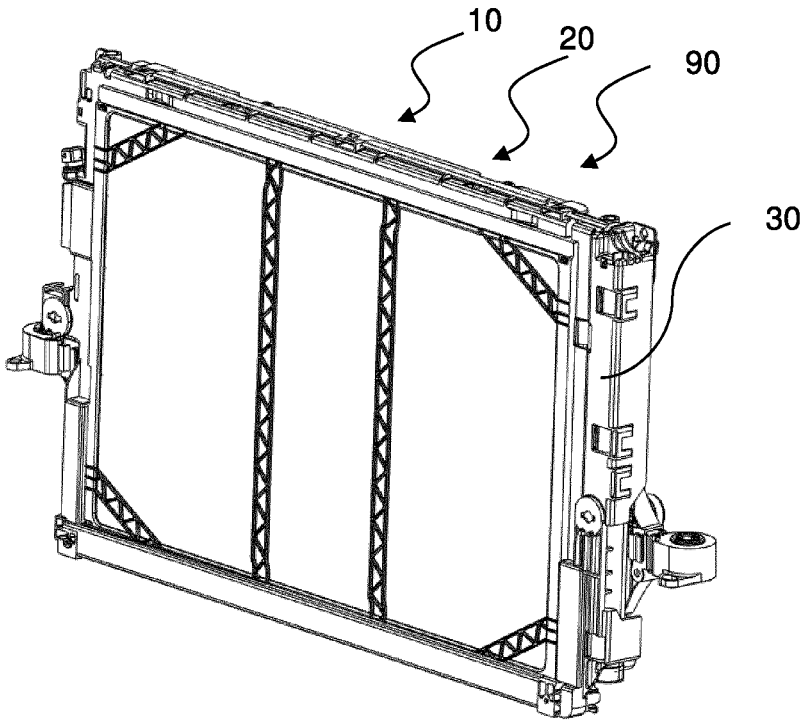
FIG. 4 shows a perspective view of a cooling assembly comprising a frame.

FIG. 4 shows the cooling assembly 1 comprising a frame 30 configured to serve as a support for heat exchangers 10, 20. The frame 30 is adapted to the shape and size of the heat exchangers 10, 20 and it may define the heat exchange area of the whole cooling assembly 1 by means of frame walls perpendicular to the plane delimited by the stack of the tubes 15, 25. The frame wall may overlap at least one collector box 11, 12, 21, 22, of the heat exchanger 10, 20. The frame 30 is preferably made of the synthetic material, which can withstand the vibrations, temperature differences and mechanical stress.

The frame 30 may serve as the individual support for each of the heat exchangers 10, 20. Alternatively, the frame 30 may be configured to serve as a support for the primary heat exchanger 10 only, the secondary heat exchanger 20 being fixed to the primary heat exchanger 10.

The cooling assembly 1 may comprise several (more than two) heat exchangers. For example, the cooling assembly 1 may further comprise a tertiary heat exchanger 90. The secondary heat exchanger 20 may be located in-between the primary heat exchanger 10 the tertiary heat exchanger 20, but other configurations of the heat exchangers 10, 20, 30 are also envisaged.

If the cooling assembly 1 further comprises a condenser as one of the heat exchangers 10, 20, 30, then the frame 30 may comprise a bottle support (not shown). The bottle support may further comprise a spring portion (not shown) for minimizing the mobility of the heat exchanger 10, 20, 30 with respect to the frame 30.

The subject-matter of an invention aims to solve the problem of, inter alia, packaging in motor vehicle. The specific arrangement of the heat exchangers enables to reduce the distance between their cores without a risk of collision of the sub-components of the heat exchangers. The invention further allows to reduce the weight of the vehicle, as the module requires less material to form fixing points not only between the module and the vehicle, but also between the heat exchangers forming this module. Contrary to the prior art, the module ensures no interference between the inlets and the outlets of respective heat exchangers. Further it allows to form a module with or without the outer frame, which allows to reduce the weight, or to improve the module mechanical resistance, if needed.

Other variations to the disclosed embodiments can be understood and effected by those skilled in the art in practicing the claimed invention, from a study of drawings, the disclosure, and the appended claims. The mere fact that certain measures are recited in mutually different dependent claims does not indicate that a combination of these measures cannot be used to the advantage.

The invention claimed is:

1. A cooling assembly for a motor vehicle, the cooling assembly comprising:

a primary heat exchanger comprising a pair of primary collector boxes, the primary collector boxes with primary header plates, the primary header plates being of essentially rectangular shape; a plurality of primary tubes stacked between the primary header plates, a secondary heat exchanger comprising a pair of secondary collector boxes with secondary header plates being of essentially rectangular shape; a plurality of secondary tubes stacked between the secondary collector boxes, wherein the primary heat exchanger and the secondary heat exchanger are arranged in parallel, perpendicularly to each other so that the secondary header plates of the secondary heat exchanger at least partially overlap the stack of the primary tubes of the primary heat exchanger and the primary header plates of the primary heat exchanger at least partially overlap the stack of the secondary tubes of the secondary heat exchanger.

2. The cooling assembly according to claim 1, wherein the width of the primary header plates is bigger than the width of the secondary header plates.

3. The cooling assembly according to claim 1, wherein the width of the secondary header plates is equal to the width of the primary header plates.

4. The cooling assembly according to claim 1, wherein the width of the secondary header plates is greater than the width of the primary header plates.

5. The cooling assembly according to claim 1, further comprising:

a plurality of protruding clips, fully supported by the secondary collector boxes, and a plurality of slots, fully supported by the secondary collector boxes, the plurality of slots configured to receive said protruding clips so that the heat exchangers are immobilized with respect to each other.

6. The cooling assembly according to claim 5, wherein the clips and slots are deployed on the corner portions of the heat exchangers.

7. The cooling assembly according to claim 6, wherein:

the plurality of slots is installed on a first pair of shoulders, comprising:

a first shoulder extending in a longitudinal direction from a first primary collector box among the primary collector boxes, the first shoulder fully supported by the first primary collector box, and a second shoulder extending in a longitudinal direction from a second primary collector box among the primary collector boxes, the second shoulder fully supported by the second primary collector box, and the plurality of protruding clips is installed on a second pair of shoulders, comprising:

a third shoulder extending in a longitudinal direction from a first secondary collector box among the secondary collector boxes, the third shoulder fully supported by the first secondary collector box, and a fourth shoulder extending in a longitudinal direction from a second secondary collector box among the secondary collector boxes, the fourth shoulder fully supported by the second secondary collector box.

8. The cooling assembly according to claim 1, further comprising a frame configured to support at least one heat exchanger, wherein the first heat exchanger, the second heat exchanger and the frame are configured to be collectively installed, as the cooling assembly, in the motor vehicle.

9. The cooling assembly according to claim 8, wherein the frame forms a screen for protecting the collector boxes and the header plates, the screen being in form of at least one wall parallel to the plane delimited by the stack of tubes and overlapping at least one tank of any heat exchanger.

10. The cooling assembly according to claim 1 comprising a tertiary heat exchanger, the tertiary heat exchanger comprising tertiary header plates, the tertiary header plates being parallel to the primary header plates.

* * * * *